US007421796B1

(12) United States Patent
DeAngelis-Morris

(10) Patent No.: US 7,421,796 B1
(45) Date of Patent: Sep. 9, 2008

(54) POSITIONING TEMPLATE

(76) Inventor: Nancy DeAngelis-Morris, 26 Harreton Rd., Allendale, NJ (US) 07401

( * ) Notice: Subject to any disclaimer, the term of this patent is extended or adjusted under 35 U.S.C. 154(b) by 15 days.

(21) Appl. No.: 11/787,877

(22) Filed: Apr. 17, 2007

(51) Int. Cl.
*G01D 21/00* (2006.01)

(52) U.S. Cl. ..... 33/613; 33/1 B; 33/1 G; 33/562

(58) Field of Classification Search ..... 33/613
See application file for complete search history.

(56) References Cited

U.S. PATENT DOCUMENTS

| | | | | |
|---|---|---|---|---|
| 2,610,413 | A * | 9/1952 | Dasey | 33/562 |
| 4,443,949 | A | 4/1984 | Newton | |
| 5,076,612 | A | 12/1991 | Nirmel | |
| 5,238,271 | A | 8/1993 | Nirmel | |
| 5,240,287 | A * | 8/1993 | Nirmel | 283/101 |
| 6,372,075 | B1 * | 4/2002 | Johnson | 156/247 |
| 6,449,863 | B1 | 9/2002 | Voorhees | |
| 6,618,955 | B2 | 9/2003 | Rice | |
| 6,684,518 | B2 | 2/2004 | Voorhees | |
| 6,729,035 | B1 | 5/2004 | Carrillo | |
| 6,880,259 | B1 | 4/2005 | Schultz | |
| 7,185,442 | B2 * | 3/2007 | Grillo | 33/613 |
| 2003/0115767 | A1 * | 6/2003 | Wedekind et al. | 33/566 |
| 2005/0263654 | A1 | 12/2005 | Grillo | |

* cited by examiner

*Primary Examiner*—Christopher W Fulton
(74) *Attorney, Agent, or Firm*—Arnold D. Litt, Esq.; Herten, Burstein, Sheridan, Cevasco, Bottinelli, Litt & Harz, LLC

(57) ABSTRACT

A positioning template for use in aiding in the hanging of objects on various supporting surfaces includes an electrostatically active template backing having a front surface and a rear surface, a plurality of perimeter markers shaped and dimensioned for releasable selective placement on the front surface of the template backing in a manner representing outer dimensions of an object to be hung, and a hole marker shaped and dimensioned for releasable selective placement on the front surface of the template backing to indicate a desired position of a hole for an anchoring device.

10 Claims, 6 Drawing Sheets

POSITIONING TEMPLATE

BACKGROUND OF THE INVENTION

1. Field of the Invention

The invention relates to a positioning template. More particularly, the invention relates to a positioning template that uses an electrostatic material in conjunction with movable markers to provide a user with a visual representation of an object to be hung on a wall, or other flat surface.

2. Description of the Related Art

The art of hanging decorations in a home and/or office can be a challenging and time-consuming task. The task as traditionally performed requires at least two individuals; one to hold the decoration against the supporting surface (for example, the wall), while the other individual identifies the most appealing location for the object and marks the location for the anchoring device on the supporting surface. The anchoring device is then secured to the supporting surface at the point that was marked and the decoration is hung from it.

Problems can easily arise from the traditional approach. For example, the object to be hung could be rather large and/or heavy and cannot be lifted by one individual. To resolve the problem, either another individual needs to be recruited for the task or estimations need to be made regarding the placement of the object on the surface. Using estimations will leave the user with some uncertainties, which could cause the decoration to be hung in a manner that is not intended by the individual. If, however, another individual needs to be found to aid in the task, that can add to the total time to complete the task.

Another commonly occurring problem is marking the location of the anchoring device. Because the decoration's support, which will engage the anchoring device, is commonly located behind the decoration itself, such as a painting, defining the correct location of the wall-anchoring device can be difficult. It generally requires precise measurements and can be a time consuming task. Estimations are often made by the individual marking what they predict to be the correct location on the supporting surface where the object is to be mounted. If the estimated location is incorrect, the supporting surface is left with an undesirable marking.

There have been efforts made in the field to aid individuals in the process of hanging objects upon a variety of supporting surfaces. However, these prior efforts have shortcomings ranging from difficulty in use to leaving undesirable adhesives on the surface. Additionally, these prior efforts lack flexibility to provide for reconfiguration for use with a multitude of decorations of different size and shape. Therefore, it is desirable to provide a reusable visual representation for hanging a variety of objects in various locations and on various supporting surfaces that when used will provide the user with flexibility in placement and not leave any unintended marks on such supporting surfaces.

SUMMARY OF THE INVENTION

It is, therefore, an object of the present invention to provide a positioning template for use in aiding in the hanging of objects on various supporting surfaces. The positioning template includes an electrostatically active template backing having a front surface and a rear surface, a plurality of perimeter markers shaped and dimensioned for releasable selective placement on the front surface of the template backing in a manner representing outer dimensions of an object to be hung, and a hole marker shaped and dimensioned for releasable selective placement on the front surface of the template backing to indicate a desired position of a hole for an anchoring device.

It is also an object of the present invention to provide a positioning template wherein the template backing is composed of an acetate sheet material and electrostatically releasably adheres to various supporting surfaces for temporary placement.

It is another object of the present invention to provide a positioning template wherein the template backing has vertical and horizontal parallel lines on its surface to form a grid pattern.

It is a further object of the present invention to provide a positioning template wherein the perimeter markers are L-shaped and composed of an electrostatically active material that adheres to the front surface of the template backing.

It is also another object of the present invention to provide a positioning template wherein the hole marker is composed of a sheet material which electrostatically releasably adheres to the front surface of the template backing.

It is a further object of the present invention to provide a method for hanging an object on a supporting surface using a positioning template. The method includes placing a rear surface of an electrostatically active template backing on a surface of an object to be hung and placing perimeter markers on a front surface of the electrostatically active template backing to form an outline of a perimeter of the object to be hung. Next, the rear surface of the electrostatically active template is placed on a rear surface of the object to be hung so the perimeter markers lie about the perimeter of the object to be hung. A hole marker is then placed on the front surface of the electrostatically active template backing exactly over a mounting spot as dictated by a mounting device of the object to be hung to create a fully constructed positioning template. The fully constructed positioning template may then be placed on the supporting surface where the user intends to hang the object to be hung by placing the rear surface of the electrostatically active template backing on the surface.

It is also an object of the present invention to provide a method including the step of puncturing the hole marker and the supporting surface with an anchoring mechanism.

It is another object of the present invention to provide a method including the step of removing the anchoring mechanism along with the positioning template, properly securing the anchoring mechanism to the supporting surface and hanging the object to be hung via the mounting device.

It is also an object of the present invention to provide a method wherein the step of placing perimeter markers includes placing four L-shaped perimeter markers to define the outline of the perimeter of the object to be hung.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
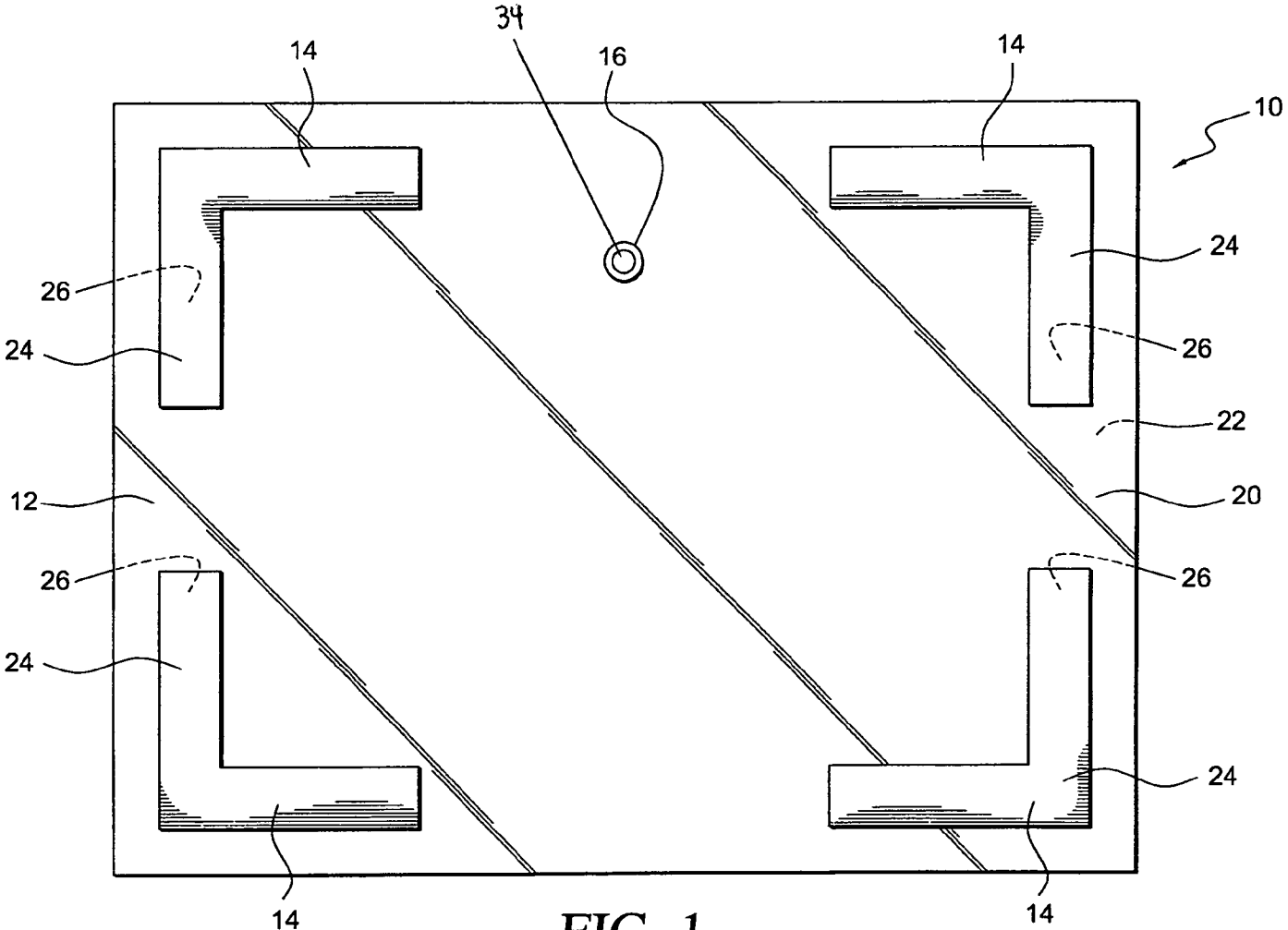
FIG. 1 is a front view of a fully constructed positioning template.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to the various figures, a positioning template 10 is disclosed. The positioning template 10 aids users in hanging objects on various supporting surfaces 32 (for example, a framed picture 18 upon a wall 32 as shown in FIG. 2F). The positioning template 10 includes an electrostatically active template backing 12 having a front surface 20 and a rear surface 22. The positioning template 10 also includes a plurality of perimeter markers 14 shaped and dimensioned for selective placement on the front surface 20 of the template backing 12 in a manner representing outer dimensions of an object to be hung. A hole marker 16 shaped and dimensioned for releasable selective placement on the front surface 20 of the template backing 12 to indicate a desired position of a hole for a mounting or anchoring device is also provided.

The positioning template 10 provides a visual representation of an object to be hung on a supporting surface 32 through the combined use of electrostatically active template backing 12, positioning perimeter markers 14 and hole marker 16. Through use of electrostatically active materials, the positioning template 10 provides a user the flexibility of a multi-use template that can be used with a variety of different sized and shaped objects that require hanging. In addition, the present positioning template 10 allows a user to have a physical representation of the object to be hung in the desired location without leaving behind unintended markings or adhesive materials on the supporting surface 32 once the positioning template 10 is removed. For example, the positioning template 10 can be used to hang a framed picture 18 on a supporting surface 32, such as a wall. By using a representation of the picture, it allows a user the flexibility to find the proper location and eases the process of hanging the picture because the user can use the positioning template 10 to visualize what the object would look like on the wall rather than the traditional inconvenient and inaccurate method of holding up the picture to see what it would look like.

The invention as shown in FIG. 1 is a picture hanging positioning template 10, but those skilled in the art will appreciate this device can be used to hang a variety of objects, such as home and office decorations, electronic devices such as wall mounted televisions, and wall mounted furniture to name a few, that are commonly hung on a wall, or other supporting surface 32.

As shown in FIG. 1, and as briefly discussed above, the positioning template 10 includes an electrostatically active template backing 12 with a front surface 20 and a rear surface 22. The template backing 12 is composed of an electrostatically active lightweight transparent or translucent acetate sheet material, or other acetate film similar to the cellulose acetate film as manufactured by Grafix Plastics of Cleveland Ohio or by United States Plastics Corp. of Lima, Ohio. The gauge of the film that is most durable and provides optimum static attraction has been found in sheets of approximately 0.004" in thickness. Any film utilized as template backing 12 would require a pressure sensitive finish that allows the rear surface 22 of template backing 12 to temporarily adhere to a variety of supporting surfaces 32 through static electricity. By adhering to the supporting surface 32 using static electricity, the template backing 12 will not leave behind any unintended markings or adhesive substances on the supporting surface 32 when it is removed.

Four L-shaped perimeter markers 14 with a front surface 24 and rear surface 26 are used in conjunction with the template backing 12. The L-shaped perimeter markers 14 are used in conjunction with the template backing 12 for representing the outer dimensions of the desired object to be hung, for example, the framed picture 18. The L-shaped perimeter markers 14 are constructed from an electrostatically active, lightweight opaque vinyl film material, or opaque acetate sheet material that will allow the rear surface 26 of the L-shaped perimeter markers 14 to be selectively adhered to the front surface 20 of template backing 12 through the use of static electricity in the manner described below in greater detail. By constructing the L-shaped perimeter markers 14 from a vinyl film material, such as cling vinyl as manufactured by Grafix Plastics of Cleveland, Ohio, that will electrostatically adhere to the front surface 20 of template backing 12, the positioning template 10 becomes a multi-use device and provides the user with flexibility in regards to the sizes and shapes of objects to be represented or simulated through the use of the present invention.

Although the perimeter markers are disclosed as being L-shaped in accordance with a preferred embodiment, it is contemplated other shapes may be useful in representing other objects and those skilled in the art will appreciate the various shapes that may be used in accordance with the present invention. In addition, although the four perimeter markers are disclosed in accordance with a preferred embodiment of the present invention, greater or fewer perimeter markers may be provided without departing from the spirit of the present invention.

In accordance with an alternate embodiment, it is contemplated the perimeter markers could be eliminated altogether if the positioning template were marketed for use with a specific object to be mounted, by the incorporation of pre-printed perimeter markings on the front surface of the template backing, representing the outer dimensions of the object to be hung. This would, of course, eliminate the need for the user to perform steps to attach perimeter markers as described below.

The hanging positioning template 10 further includes a hole marker 16 constructed from a vinyl film or acetate sheet material with properties similar to that material used for the L-shaped perimeter markers 14 described above. The hole marker 16 is movable and contains a cutout center 34 to mark the desired location of the mounting device, or anchoring mechanism, 28 of the object to be hung. In practice, and as discussed below in greater detail, the clear properties of the positioning template 10 enable hole marker 16 to be accurately placed on the front surface 20 of template backing 12 while template backing 12 is in position over the object to be hung.

It is further contemplated in accordance with an alternate embodiment the clear properties of the positioning template comprised of an electrostatically active template backing with a front surface will also allow for the use of a dry erase marker to indicate the desired location of the anchoring mechanism of the object to be hung. The use of a dry erase marker would then eliminate the need for the user to attach a hole marker to the front surface of the template backing as described below. If the positioning template were marketed for use with a specific object to be mounted, by the incorporation of a pre printed hole marking in a fixed location on the front surface of the template, the hole market could be eliminated altogether. This would, of course, eliminate the need for the user to perform steps to attach the hole marker as described below.

Briefly, the present positioning template 10 is used for hanging of objects on various surfaces by first placing a rear surface 22 of the template backing 12 on a front surface 15 of an object to be hung, for example, a framed picture 18. Thereafter, perimeter markers 14 are placed on a front surface 20 of the template backing 12 to form an outline of a perimeter of the framed picture 18 so the perimeter markers 14 lie exactly on top of the perimeter of the framed picture 18. Next, the rear surface 22 of the template backing 12 is placed on the rear surface 17 of the framed picture 18 with the perimeter markers 14 lying equidistant from, and about the perimeter of the rear surface 17 of the framed picture 18. A hole marker 16 is then placed on the front surface 20 of the template backing 12 exactly over the required mounting spot as dictated by a mounting device 28 of the framed picture 18 to create a fully constructed positioning template 10. The fully constructed positioning template 10 is then placed on the supporting surface 32 where the user intends to hang the framed picture 18 by placing the rear surface 22 of the template backing 12 on the supporting surface 32. Thereafter, the hole marker 16 and supporting surface 32 are punctured with an actual anchoring mechanism 30, the anchoring mechanism 30 along with the positioning template 10 are removed. The anchoring mechanism 30 is then secured to the supporting surface 32 and the framed picture 18 is hung via the mounting device 28.

Figure 2A:
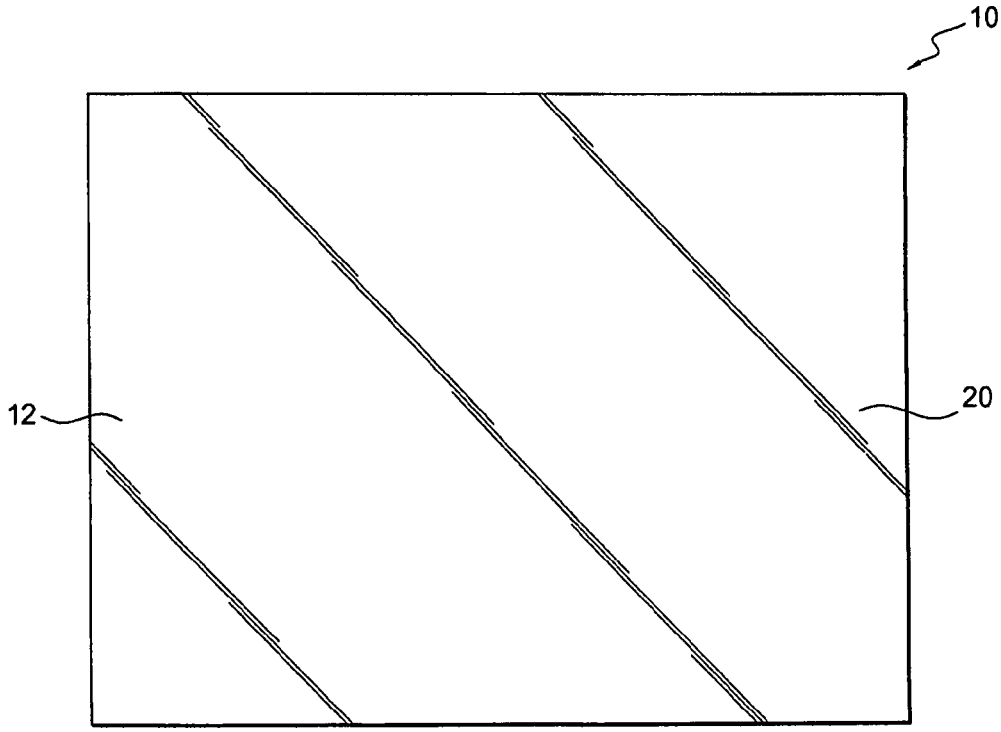
FIGS. 2A-2F show the steps in the construction and use of the positioning template in the present invention.
Figure 2B:
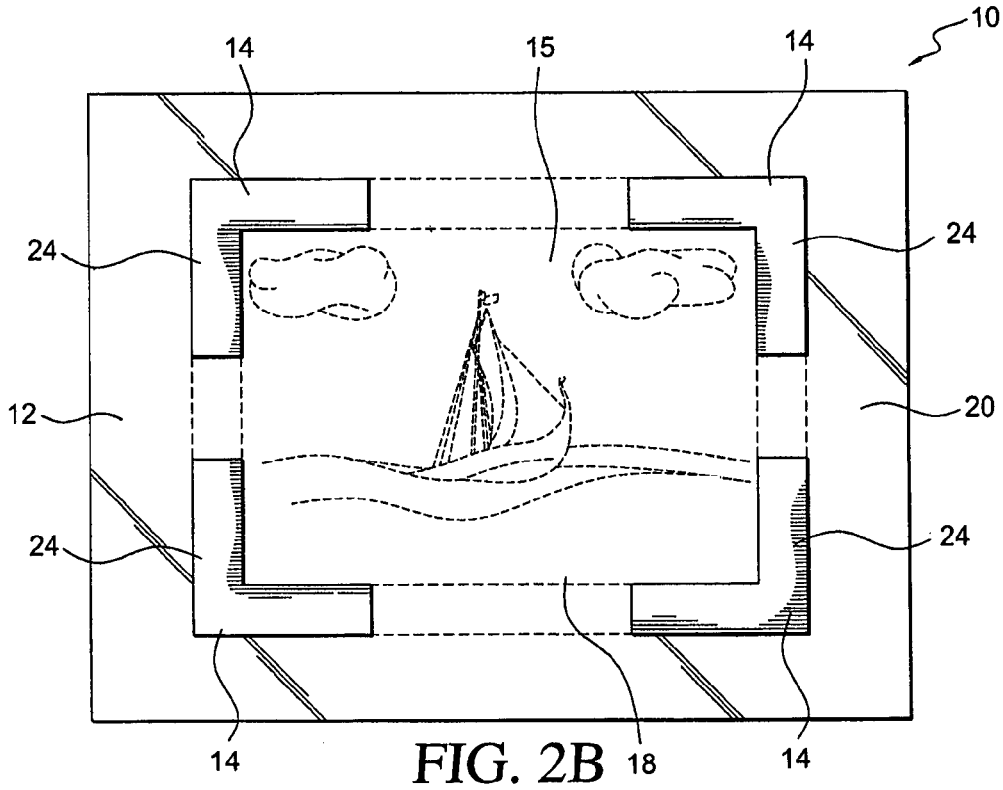
Figure 2C:
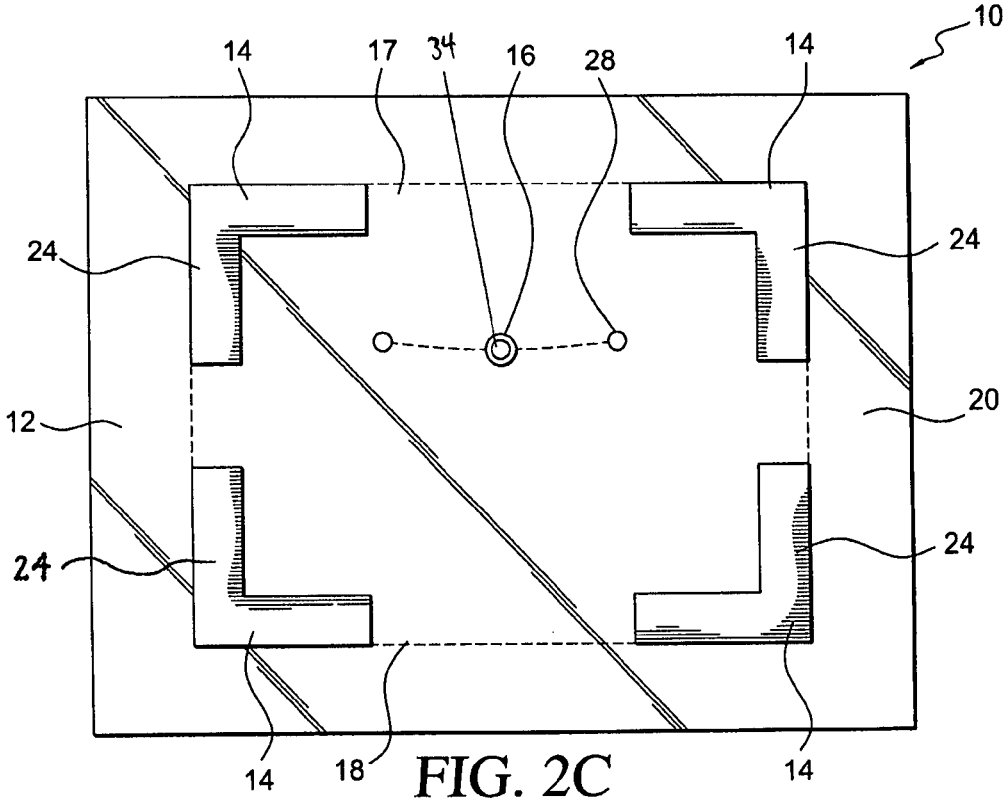
Figure 2D:
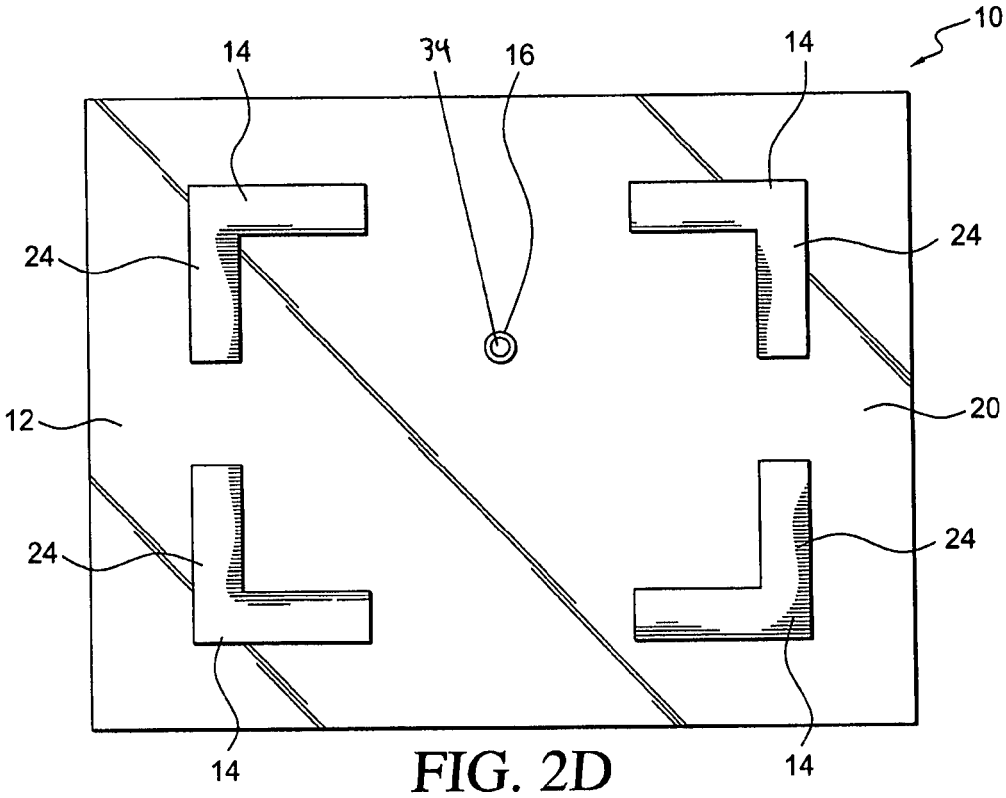
Figure 2E:
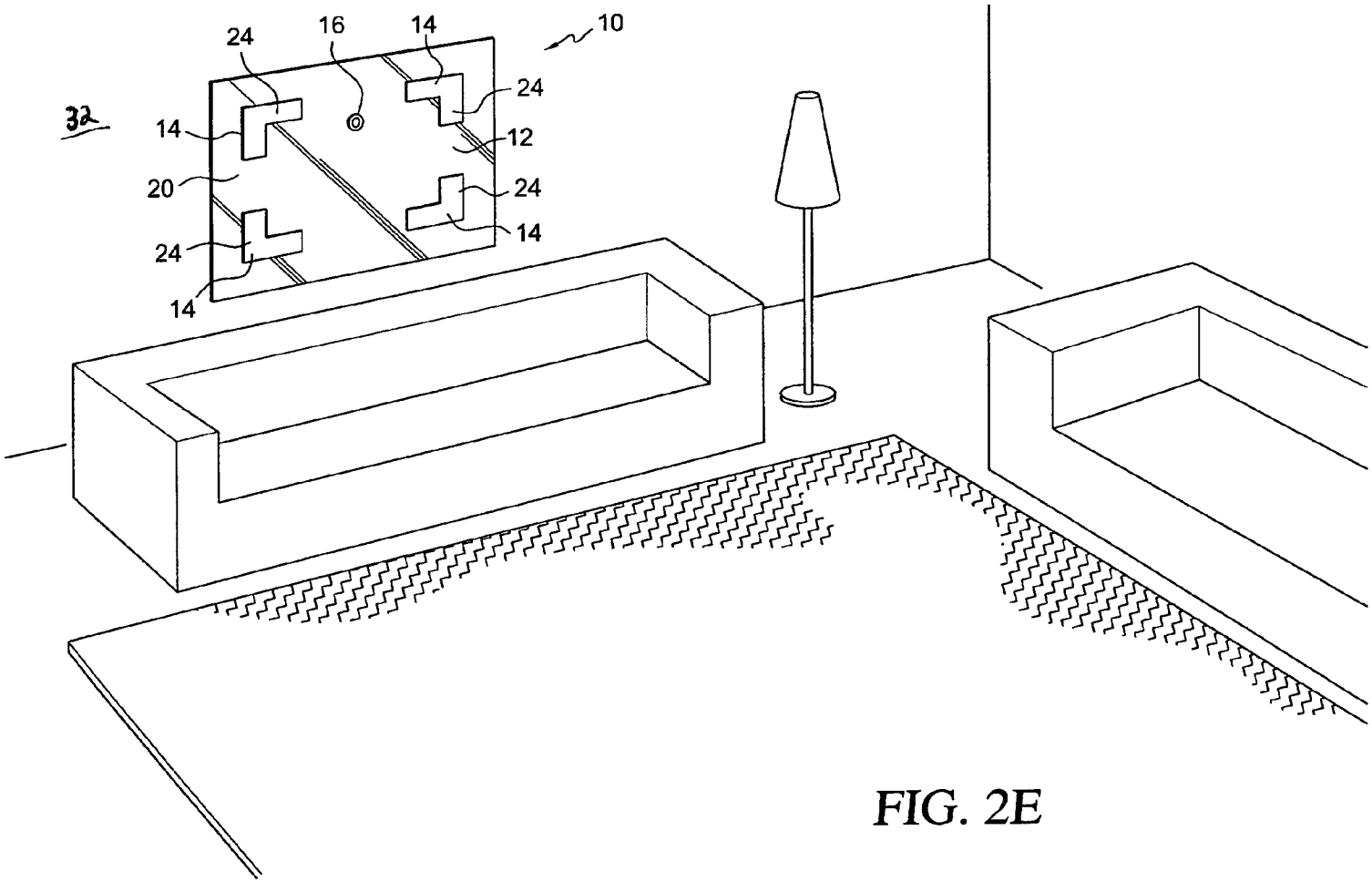
Figure 2F:
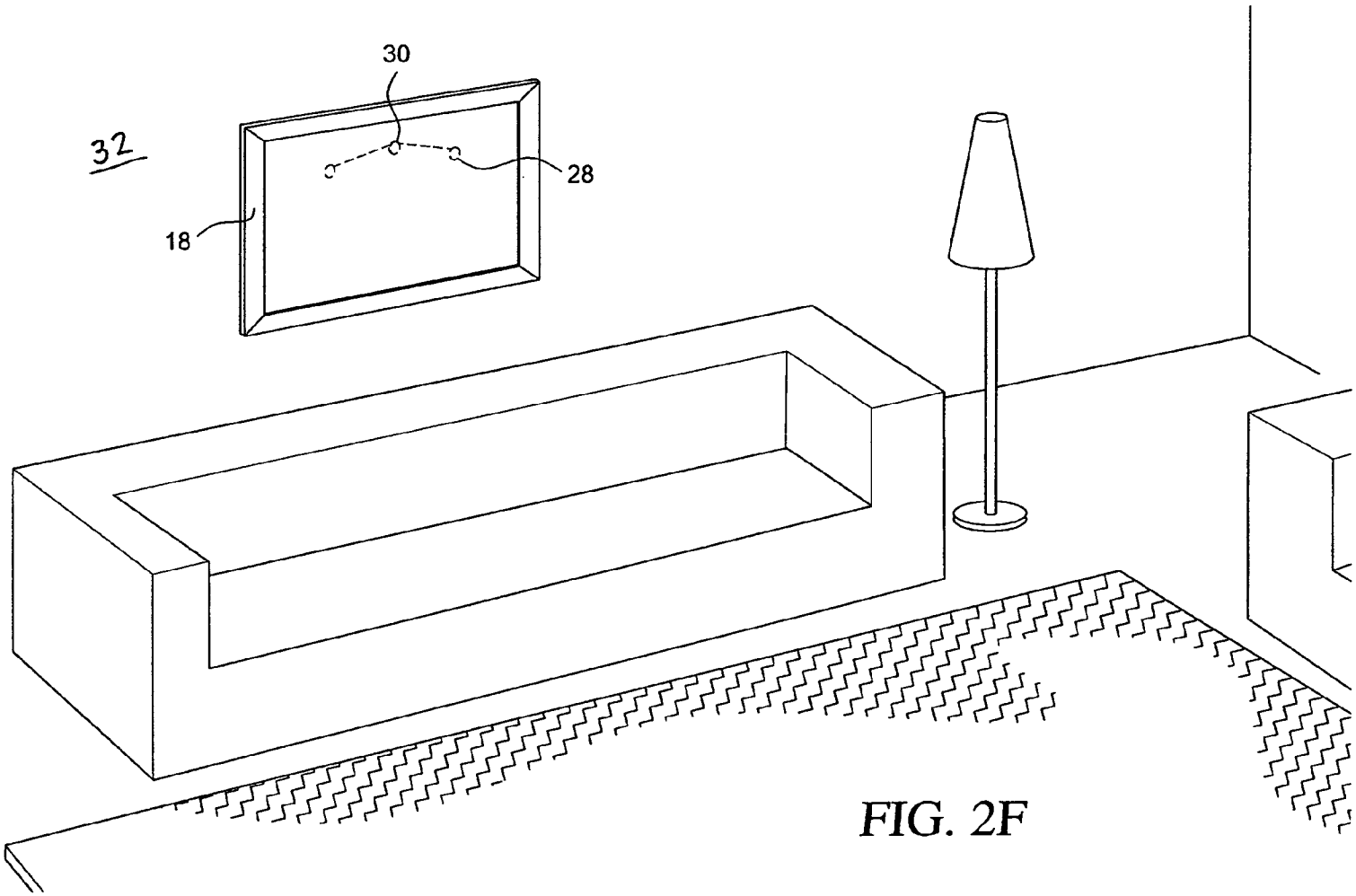

FIGS. 2A-2F disclose the use of the present positioning template 10 with a framed picture 18 as the desired object to be hung. FIG. 2A shows a clear front surface 20 of template backing 12. FIG. 2B shows the front surface 15 of framed picture 18 first placed behind the template backing 12, with the rear surface 22 of the template backing 12 positioned upon the front surface 15 of the framed picture 18, allowing visualization of the front surface 15 of the framed picture 18 through the template backing 12. The rear surfaces 26 of each of the four L-shaped perimeter markers 14 are then placed on the front surface 20 of template backing 12 directly on top of the four corners of the framed picture 18 to form an outline of the perimeter of the front surface 15 of framed picture 18.

Referring to FIG. 2C, the rear surface 22 of template backing 12 is then placed on top of the rear surface 17 of framed picture 18 so the front surface 20 of the template backing 12 and the front surfaces 24 of the four L-shaped perimeter markers 14 are visible to the user. The placement of the positioning template 10 is dictated by the four L-shaped perimeter markers 14 so that the four L-shaped perimeter markers 14 are equidistant from the perimeter of the rear surface 17 of the framed picture 18.

In cases where the front and rear perimeters of the framed picture 18 are the same, as would exist when the sides of the framed picture 18 are flat and at 90 degree angles from the front and rear surfaces 15, 17 of the framed picture 18, the positioning template 10 would then be placed on top of the rear surface 17 of framed picture 18 so that the four L-shaped perimeter markers 14 lie exactly on top of the perimeter of the rear surface of the framed picture 18. If this were the case, the user could have placed the four L-shaped perimeter markers 14 on the front surface 20 of the template backing 12 while the framed picture 18 was placed front surface down, thereby eliminating the step described above where the front surface of the framed picture 18 is visible to the user. This allows the rear surface 17 of framed picture 18 to become visible as shown in FIG. 2C.

The hole marker 16 is then placed on the front surface 20 of template backing 12 exactly over the required mounting spot as dictated by the mounting device 28 of framed picture 18. As the mounting device 28, or hardware, affixed to the rear surface 17 of framed picture 18 may be of several types, placement of the hole marker 16 will vary and may even require the placement of two or more hole markers 16. A single fixed mounting device 28 on the rear surface 17 of the framed picture 18 will require the user to place the hole marker 16 on the front surface 20 of the template backing 12 exactly in position over the mount hole location on the rear surface 17 of framed picture 18, as viewed through template backing 12. As those skilled in the art will certainly appreciate, two fixed mounting hardware devices on the rear surface of a framed picture would require placement of two hole markers on the front surface of the template backing exactly in position over each of the mount hole locations on the rear surface of framed picture, as viewed through the template backing.

Alternatively, a mounting device 28 on the rear surface 17 of framed picture 18, such as a hanging wire depicted in FIGS. 2C and 2F, would require placement of hole marker 16 on the front surface 20 of positioning template 10 at the discretion of the user. The position would be based upon their judgment in order to properly hang the framed picture 18 in a level position upon a supporting surface 32. Consistent with the traditional hanging of an object containing hanging hardware on the rear surface of the object to be hung, use of a level or other measuring device can aid the user in locating the position(s) of required mounting point(s).

The positioning template 10 is then removed from the framed picture 18 and the fully constructed positioning template 10 is shown in FIG. 2D. Referring to FIG. 2E, the fully constructed positioning template 10 is then placed on the supporting surface 32 where the user intends to hang the framed picture 18 by placing the rear surface 22 of the template backing 12 on the supporting surface 32. Once the positioning template 10 has adhered to the supporting surface 32 via the electrostatic properties of the sheet material from which the template backing 12 is composed, the user then has the ability to visualize, through the use of a physical representation, what the object to be hung will look like on the supporting surface 32 as shown in FIG. 2E. The fully constructed template 10 is then repositioned upon the supporting surface 32 until placed in a position deemed as a desirable location for the object to be hung. Once the user determines the proper positioning and location using the positioning template 10, the user then punctures hole marker 16 and the supporting surface 32 with the actual anchoring mechanism 30 which will hold the framed picture 18 to be hung upon the supporting surface 32. The anchoring mechanism 30 is then removed along with hanging positioning template 10. The anchoring mechanism 30 is then properly secured to the supporting surface 32 and the object to be hung can then be secured to the supporting surface 32 via the mounting device 28 as shown in FIG. 2F.

Figure 3:
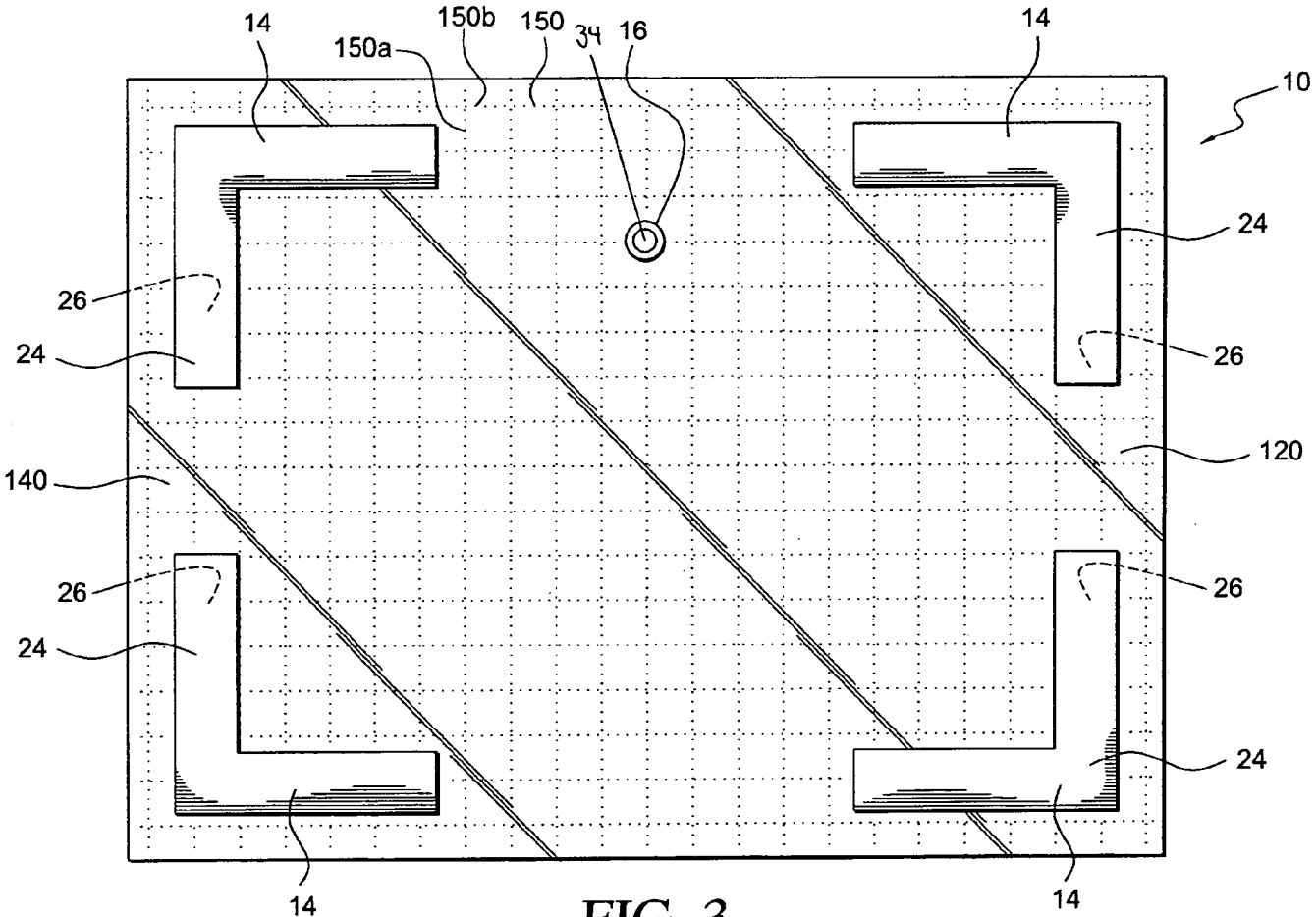
FIG. 3 is an alternate embodiment of the present invention that includes a grid template backing.

FIG. 3 shows an alternate embodiment of the present invention. In accordance with this embodiment, the template backing 120 is constructed with a grid pattern 150 composed of vertical and horizontal parallel lines 150*a*, 150*b* located on the front surface 140 of template backing 120 to help aid in the construction of the positioning template 10 and the alignment process.

The innovation of the invention resides in the reconfigurable structure of the positioning template 10 which can represent a variety of objects, and the flexibility in the placement of the template by not leaving any unintended marking once removed from a supporting surface 32. The invention further simplifies the process of hanging objects because a user will no longer require another individual to hold the object on the supporting surface 32 while the user determines the location and marks the supporting surface 32 for the location of the anchoring mechanism.

Although the disclosed example presents the hanging of a single picture, one skilled in the art will appreciate multiple templates in accordance with the present invention may be used where an individual is hanging multiple objects.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A positioning template for use in aiding in the hanging of objects on various supporting surfaces, comprising:

an electrostatically active template backing having a front surface and a rear surface;

a plurality of perimeter markers shaped and dimensioned for releasable selective placement on the front surface of the template backing in a manner representing outer dimensions of an object to be hung; and a hole marker shaped and dimensioned for releasable selective placement on the front surface of the template backing to indicate a desired position of a hole for an anchoring device.

2. The positioning template according to claim 1, wherein the template backing is composed of an acetate sheet material and electrostatically releasably adheres to various supporting surfaces for temporary placement.

3. The positioning template according to claim 2, wherein the template backing has vertical and horizontal parallel lines on its surface to form a grid pattern.

4. The positioning template according to claim 1, wherein the plurality of perimeter markets are L-shaped and composed of an electrostatically active material that releasably adheres to the front surface of the template backing.

5. The positioning template according to claim 1, wherein the hole marker is composed of a sheet material which electrostatically releasably adheres to the front surface of the template backing.

6. A method for hanging of an object on a supporting surface using a positioning template, comprising the following steps:

placing a rear surface of an electrostatically active template backing on a surface of an object to be hung;

placing perimeter markers on a front surface of the electrostatically active template backing to form an outline of a perimeter of the object to be hung;

placing the rear surface of the electrostatically active template on a rear surface of the object to be hung so the perimeter markers lie about the perimeter of the object to be hung;

placing a hole marker on the front surface of the electrostatically active template backing exactly over a mounting spot as dictated by a mounting device of the object to be hung to create a fully constructed positioning template;

placing the fully constructed positioning template on the supporting surface where the user intends to hang the object to be hung by placing the rear surface of the electrostatically active template backing on the surface.

7. The method according to claim 6, further including the step of puncturing the hole marker and the supporting surface with an anchoring mechanism.

8. The method according to claim 7, further including the step of removing the anchoring mechanism along with the positioning template, properly securing the anchoring mechanism to the supporting surface and hanging the object to be hung via the mounting device.

9. The method according to claim 6, wherein the step of placing perimeter markers includes placing four L-shaped perimeter markers to define the outline of the perimeter of the object to be hung.

10. The method according to claim 6, wherein the template backing has vertical and horizontal parallel lines on its surface to form a grid pattern.

* * * * *